US005490316A

United States Patent [19]

Kimoto

[11] Patent Number: 5,490,316

[45] Date of Patent: Feb. 13, 1996

[54] CONTINUOUS TERMINAL CRIMPING MACHINE

[75] Inventor: Koichi Kimoto, Kanazawa, Japan

[73] Assignee: Sumitomo Wiring Systems Ltd (a corp. of Japan), Mie, Japan

[21] Appl. No.: 257,015

[22] Filed: Jun. 8, 1994

[30] Foreign Application Priority Data

Jun. 11, 1993 [JP] Japan ..... 5-140877

[51] Int. Cl.[6] ..... H01R 43/04

[52] U.S. Cl. ..... 29/564.4; 29/748

[58] Field of Search ..... 29/33 M, 564.4, 29/566.1, 566.3, 748, 751, 56.6; 81/9.51

[56] References Cited

U.S. PATENT DOCUMENTS

| | | | |
|---|---|---|---|
| 3,559,698 | 2/1971 | Smith | 29/751 X |
| 3,570,100 | 3/1971 | Kindell et al. | 29/564.4 |
| 3,748,932 | 7/1973 | Neiman et al. | 81/9.51 |
| 3,867,754 | 2/1975 | Koch et al. | 29/56.6 |
| 3,968,548 | 7/1976 | Clark et al. | 29/33 M |
| 4,612,696 | 9/1986 | Talley | 29/564.4 |
| 4,616,386 | 10/1986 | Schmid | 29/33 M |
| 4,622,733 | 11/1986 | Fukuda et al. | 29/564.4 |
| 4,713,880 | 12/1987 | Dusel | 29/564.4 |
| 4,970,777 | 11/1990 | Folk et al. | 29/748 |

FOREIGN PATENT DOCUMENTS

| | | |
|---|---|---|
| 57-31275 | 7/1982 | Japan . |
| 1-106093 | 7/1989 | Japan . |
| 4-78795 | 7/1992 | Japan . |

*Primary Examiner*—William Briggs
*Attorney, Agent, or Firm*—Beveridge, DeGrandi, Weilacher & Young

[57] ABSTRACT

There is disclosed a continuous terminal crimping machine for continuously cutting an electric wire intermittently fed, stripping an end of the cut electric wire, and crimping a terminal on the stripped end of the electric wire. The crimping machine includes a rotatable arm for clamping the end of the electric wire fed along a feeding path to move the same to a predetermined position of a terminal crimping apparatus disposed beside the feeding path and returning the same to the feeding path after the terminal is crimped on the end of the moved electric wire. When the arm stops rotation, an oil damper is caused to abut against surfaces for determining the position where the arm is to be stopped. The oil damper produces damping force caused by viscous resistance to absorb shock at the time that the rotation of the arm is stopped.

12 Claims, 12 Drawing Sheets

CONTINUOUS TERMINAL CRIMPING MACHINE

CROSS REFERENCE TO RELATED APPLICATION

This application claims priority benefits under 35 USC §119 of Japanese Patent Application Serial No. 5-140877, the disclosure of which is incorporated by reference.

BACKGROUND OF THE INVENTION

1. Field of the Invention

The present invention relates to a continuous terminal crimping machine for continuously cutting an electric wire intermittently fed along a predetermined feeding path, stripping an end of the cut electric wire, and crimping a terminal on the stripped end of the electric wire.

2. Description of the Related Art

There has been conventionally a continuous terminal crimping machine so adapted as to crimp terminals on both ends of an electric wire cut to a predetermined length. In the continuous terminal crimping machine, operations performed until a terminal is crimped on a front end of the electric wire in the direction of feeding (so-called "A end") are as follows. Specifically, the electric wire is fed along a predetermined feeding path, and the electric wire is cut and an end of the electric wire is stripped on the feeding path. Thereafter, in a state where the stripped end of the electric wire positioned on the feeding path is clamped by a clamping mechanism, the stripped end is moved to a predetermined position of each of terminal crimping apparatuses on both sides with the feeding path interposed therebetween, to crimp the terminal on the stripped end.

The end of the electric wire on which the terminal is crimped is then returned to the feeding path again, and the electric wire is fed by a predetermined amount, whereby the terminal is crimped on a rear end of the electric wire in the direction of feeding (so-called "B end").

The above described clamping mechanism comprises, for example, an arm rotating within a surface substantially orthogonal to the feeding path in a state where the end of the electric wire is clamped to move the end of the electric wire to a predetermined position on the feeding path and a predetermined position of the terminal crimping apparatus.

In moving the end of the electric wire to a predetermined position of the terminal crimping apparatus, the terminal is insufficiently crimped on the end of the electric wire if the end of the electric wire is not put in the predetermined position with high precision. Further, in returning the end of the electric wire to the predetermined position on the feeding path, the electric wire is insufficiently fed if the end of the electric wire sticks out of the feeding path.

Therefore, the continuous terminal crimping machine is generally provided with a positioning mechanism for causing the arm or a portion rotating with the arm to abut against a fixed portion when the rotation of the arm is terminated to regulate the position where the rotation of the arm is stopped and consequently, to regulate the position where the end of the electric wire is stopped.

On the other hand, there has been conventionally proposed a guide structure for regulating the position where an end of an electric wire is stopped in a terminal crimping machine for the purpose of preventing insufficient crimping of a terminal (see, for example, Japanese Utility Model Laid-Open Gazette No. 106093/1989 and Japanese Patent Publication No. 31275/1982). Further, there has been proposed a structure in which a top end of a nozzle holding an electric wire expands and contracts to correct a habit of winding of the electric wire for the same purpose (see, for example, Japanese Utility Model Laid-Open Gazette No. 78795/1992).

In order to reduce the cost of a wiring harness manufactured, the work speed of the continuous terminal crimping machine must be increased. In such a case, however, the above described conventional continuous terminal crimping machines having a positioning mechanism, a guide structure and a correction structure cannot prevent insufficient crimping and the like.

SUMMARY OF THE INVENTION

Therefore, the inventor of the present application has found that the cause of insufficient crimping and the like in a case where the work speed is increased is vibration of an end of an electric wire. Specifically, if the work speed is increased, an arm rotates at a high speed. When the rotating arm or the like is stopped by the abutment of the above described positioning mechanism, therefore, the arm or the like receives a very large shock due to the inertial mass of a rotating portion, thereby causing damping vibration in the end of the electric wire, and the vibration remains for a while after the stop. A terminal is crimped on the end of the electric wire whose position is shifted by the vibration, thereby causing insufficient crimping.

The present invention has been made in view of the foregoing and has for its object to realize a continuous terminal crimping machine capable of restraining the vibration of an end of an electric wire moved at the time of the stop and preventing insufficient crimping of a terminal and insufficient feeding of the electric wire which are caused by the vibration.

In order to attain the above described object, a continuous terminal crimping machine according to one aspect of the present invention is characterized by comprising electric wire feeding means for feeding an insulated electric wire along a feeding path, cutting means for cutting the electric wire on the feeding path, stripping means for stripping an end of the electric wire cut on the feeding path by the cutting means, a terminal crimping apparatus disposed beside the feeding path and crimping a terminal on the stripped end of the electric wire, a rotating arm comprising a clamping portion and clamping the stripped end of the electric wire so as to be releasable and being rotatable around a predetermined axis parallel to the feeding path to a first position where the end of the electric wire clamped by the clamping portion is stopped in a predetermined position on the feeding path and a second position where the clamped end of the electric wire is stopped in a predetermined position of the terminal crimping apparatus, a rotating mechanism comprising a member displaced as the rotating arm rotates for rotating the rotating arm so as to alternately displace the rotating arm to the first position and the second position, and shock absorbing means abutting against at least one of the rotating arm and the above described displaced member to absorb a shock when the rotating arm is stopped in at least one of the first and the second positions.

According to the above described aspect, when the rotating arm is stopped in the first position or the second position, the shock absorbing means abuts against at least one of the rotating arm and the displaced members, thereby to absorb a shock. Consequently, it is possible to prevent the vibration from being created in the end of the electric wire at the time when the rotation of the rotating arm is stopped, thereby to make it possible to prevent insufficient crimping of the terminal in the terminal crimping apparatus and insufficient feeding of the electric wire on the feeding path. Further, in each portion which receives a shock when the rotation is stopped, the shock can be conventionally released, thereby to make it possible to improve the durability of the portion.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
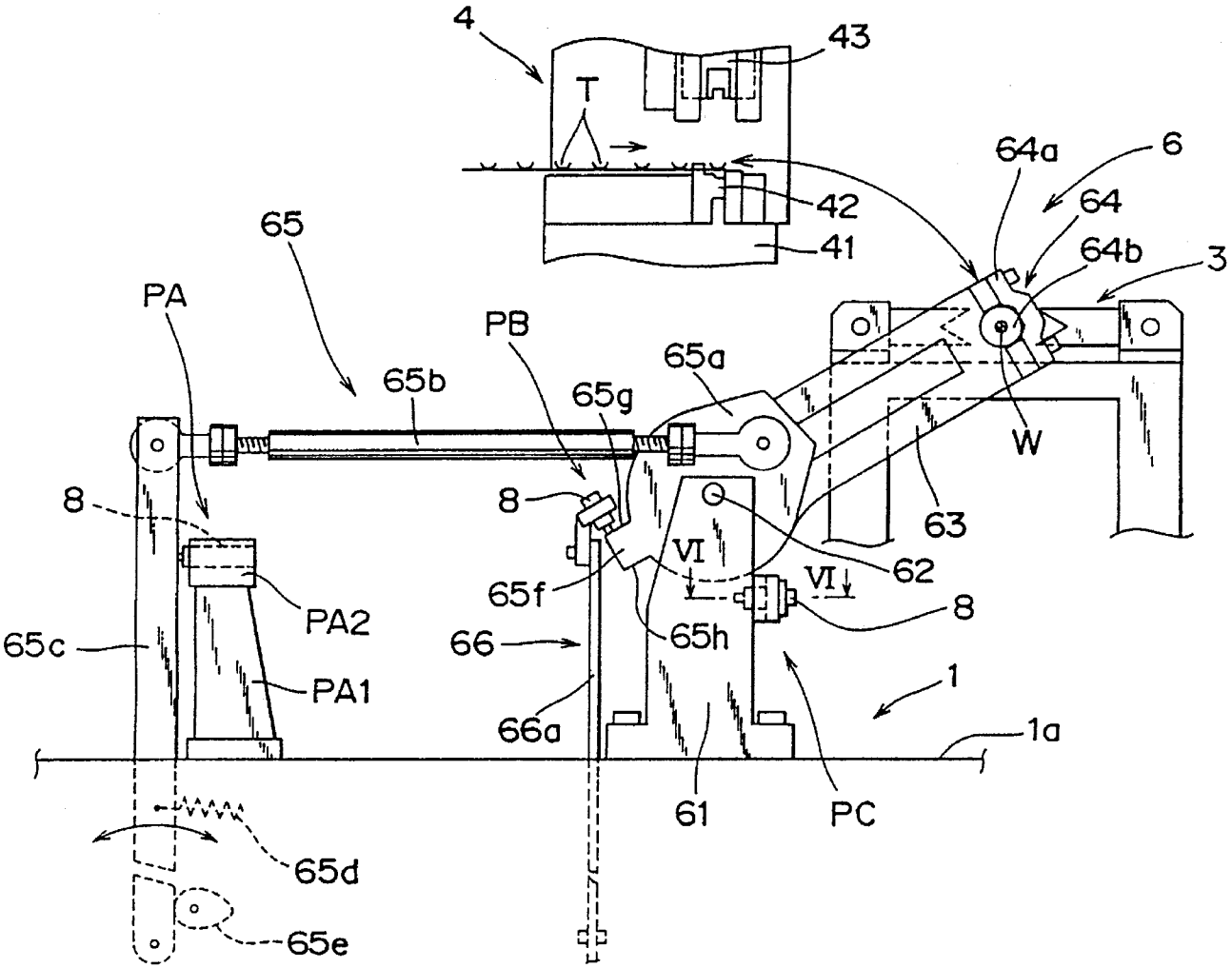
FIG. 1 is a schematic side view showing a continuous terminal crimping machine according to one embodiment of the present invention.

Embodiments will be described in detail with reference to the attached drawings. The left and right in the following refer to the left and right in the drawings.

Figure 2:
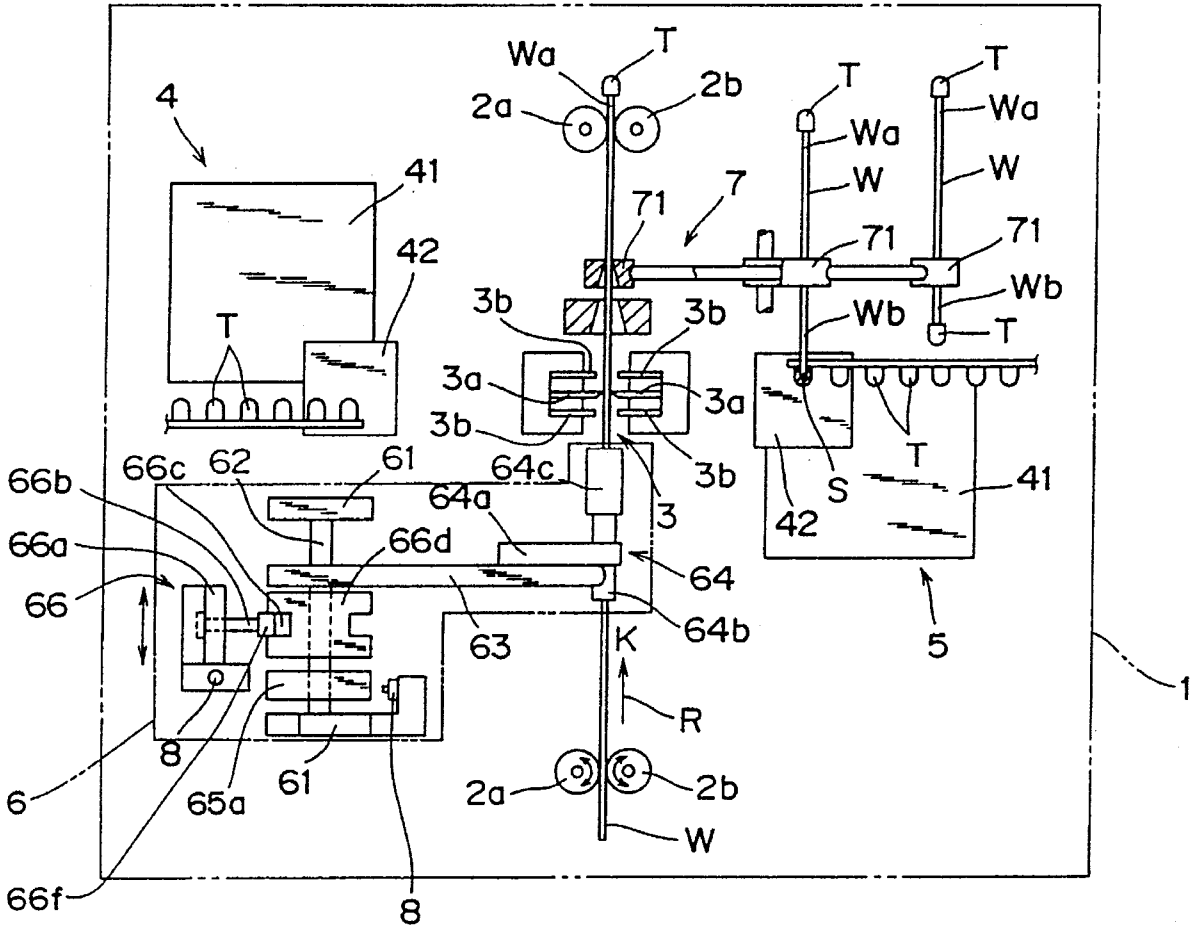
FIG. 2 is a schematic plan view showing the continuous terminal crimping machine.

Referring to FIG. 2, a machine frame 1 of a continuous terminal crimping machine is provided with:

i) a pair of feeding rollers 2*a* and 2*b* for feeding an insulated electric wire W delivered from an electric wire delivery roll (not shown) while being measured along a feeding path R extending upward and downward on paper, ii) a group of cutting edges 3 for cutting the insulated electric wire W on the feeding path R by the opening and closing movement and notching an insulated portion of the electric wire W for stripping, iii) a pair of terminal crimping apparatuses 4, 5 disposed beside the group of cutting edges 3 in a state where the feeding path R is interposed therebetween, iv) a moving clamping apparatus 6 having a clamping portion 64 for clamping the electric wire W on the upstream side of the group of cutting edges 3 in the direction of feeding K for rotating a front end Wa of the electric wire W in a surface orthogonal to the feeding path R to move the electric wire W to the terminal crimping apparatus 4, and v) an index table 7 having a plurality of clamping portions 71 for clamping a rear end Wb of the electric wire W on the downstream side of the group of cutting edges 3 in the direction of feeding K for intermittently rotating the electric wire W in a surface orthogonal to the feeding path R to move the same to the terminal crimping apparatus 5 and a discharging portion (not shown).

FIG. 2 shows a state where a terminal has been crimped on the front end Wa of one electric wire W and then, a portion to be the rear end of the electric wire W is being cut and an insulated portion of the electric wire W is being notched for stripping by the group of cutting edges 3.

The present embodiment is characterized by the following points i) and ii):

i) Referring to FIG. 1, there are provided a plurality of oil dampers 8 abutting against a predetermined portion of a rotating mechanism 65 as described later in the above described moving clamping apparatus 6 for producing a damping force for absorbing a shock at the time of the abutment, thereby to release a shock in a case where the moving clamping apparatus 6 moves the front end Wa of the electric wire W toward the terminal crimping apparatus 4 and stops the same or in a case where it returns the electric wire W to a predetermined position on the feeding path R and stops the same to prevent vibration created in the front end Wa of the electric wire W.

ii) Positioning mechanisms PA, PB and PC for determining the position where the rotation of the rotating mechanism 65 is stopped respectively include the above described oil dampers 8, and a predetermined portion of the rotating mechanism 65 is brought into metal-to metal contact with predetermined end surfaces provided for the oil dampers 8, thereby to determine the position where the rotation of the rotating mechanism 65 is stopped. Specifically, the position where the rotation of the rotating mechanism 65 is stopped can be accurately positioned by finally bringing the predetermined portion of the rotating mechanism 65 into metal-to metal contact while exerting a damping force caused by viscous resistance from just before the metal-to metal contact for positioning.

Referring to FIG. 2, the group of cutting edges 3 is of such known construction that pairs of strip edges 3*b* are respectively disposed in front of and behind the pair of cutting edges 3*a* in the direction of feeding K. The clamping portion 64 in the moving clamping device 6 is moved back and forth (moved in the K direction and in the opposite direction to K in FIG. 2) by a back-and-forth moving mechanism 66 as described later after cutting by the cutting edges 3*a* and the strip edges 3*b* to strip a cut insulated portion, to form a strip S of the electric wire W.

Referring to FIGS. 1 and 2, each of terminal crimping apparatuses 4 and 5 is of such known construction that a fixed anvil 42 is mounted on a base 41 fixed to an upper surface of the machine frame 1 and a crimper 43 movable up and down is disposed above the anvil 42. In each of the terminal crimping apparatuses 4 and 5, each of a plurality of connected terminals T and a succeeding connecting terminal band are cut while caulking the terminals T on the strip S of the electric wire W one at a time.

Referring to FIG. 1, the above described moving clamping device 6 comprises i) a pair of pillar bodies 61 disposed along the direction of paper and fixed to an upper surface 1*a* of the machine frame 1 (only one is illustrated in the figure), ii) a shaft 62 rotatably supported by the pillar bodies 61, iii) an arm 63 having a base end mounted on the shaft 62 so as to be integrally rotatable and relatively movable in the axial direction, iv) the above described clamping portion 64 fixed to a top end of the arm 63, v) the rotating mechanism 65 for rotating the clamping portion 64 through the shaft 62 and the arm 63 in a predetermined angle range, and vii) the back-and-forth moving mechanism 66 for moving the arm 63 and the clamping portion 64 back and forth along the feeding path R so as to strip an end of the electric wire W having an insulated portion notched for stripping.

The clamping portion 64 comprises i) a clamp body 64*a* fixed to the top end of the arm 63, ii) a clamp pipe 64*b* which is fixed to the clamp body 64*a* and through which the electric wire W is passed, iii) a clamp nozzle 64*c* disposed in an end of the clamp pipe 64*b* in the direction of feeding K for guiding the feeding of the electric wire W toward the group of cutting edges 3, and iv) a clamp plate (not shown) slidably supported on the clamp body 64*a* and movable to a state where it enters the clamp pipe 64*b* from the periphery of the clamp pipe 64*b* to hold the electric wire W and a state where it retreats to release the holding the electric wire W. The clamp plate is moved back and forth by a cam mechanism (not shown).

The rotating mechanism 65 comprises a substantially circular arm 65*a* rotating integrally with the shaft 62, ii) a connecting rod 65*b* having its right end rotatably mounted on a portion, which is spaced apart from the shaft 62 by a predetermined distance, of the circular arm 65*a*, iii) a swing lever 65*c* having its upper end rotatably mounted on a left end of the connecting rod 65*b* and being swingable around its lower end rotatably supported on the machine frame 1, iv) a tension spring 65*d* for rotating and urging the swing lever 65*c* in the clockwise direction in the figure, and an eccentric cam 65*e* driven by a motor (not shown) for swinging the swing lever 65*c* in the counterclockwise direction against the tension spring 65*d*.

If the eccentric cam 65*e* is rotated, the circular arm 65*a* is swung in a predetermined angle range through the swing lever 65*c* and the connecting rod 65*b*, whereby the arm 63 is swung so that the end of the electric wire W clamped by the clamping portion 64 is moved to a predetermined position on the feeding path R and a predetermined position of the terminal crimping apparatus 4. A projection 65*f* having a pair of positioning surfaces 65*g* and 65*h* on both sides in the direction of rotation is formed on a peripheral surface of the circular arm 65*a*.

Figure 5:
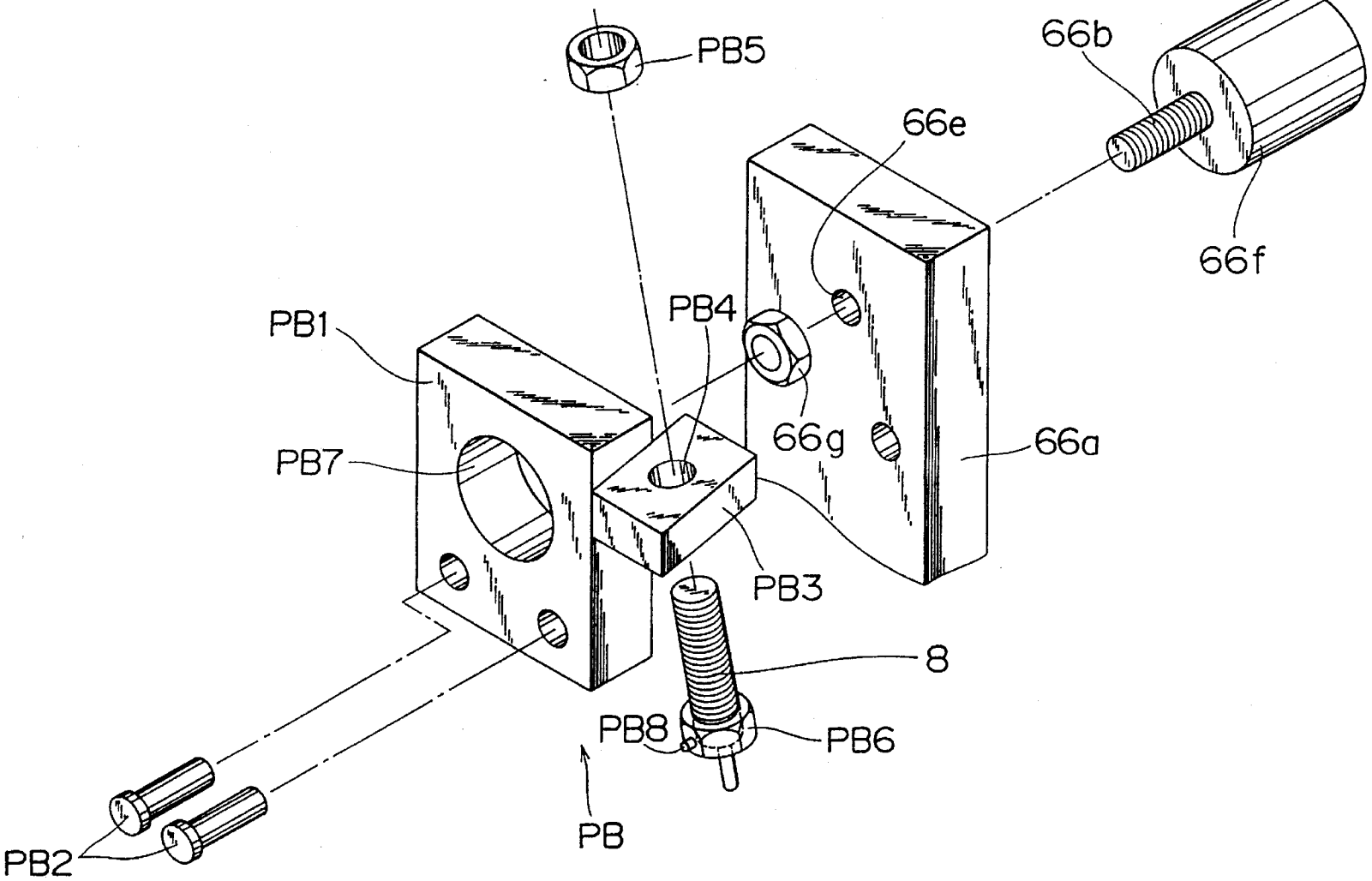
FIG. 5 is an exploded perspective view showing a positioning mechanism.

Referring to FIGS. 1, 2 and 5, the above described back-and-forth moving mechanism 66 for moving the clamping portion 64 back and forth so as to strip the cut insulated portion comprises i) a swing lever 66*a* mounted on the machine frame 1 so as to be swingable around a lower end in a vertical plane parallel to the feeding path R and swung by a driving mechanism (not shown) at a predetermined time, ii) a screw member 66*b* mounted on an upper end of the swing lever 66*a* and rotatably supporting a cam follower 66*f*, iii) a lock nut 66*g* for fixing the screw member 66*b* to the swing lever 66*a*, and a cylindrical member 66*d* mounted on the shaft 62 so as to be relatively movable in the axial direction and having an annular recess 66*c* which the cam follower 66*f* enters formed on its outer peripheral surface.

Figure 4:
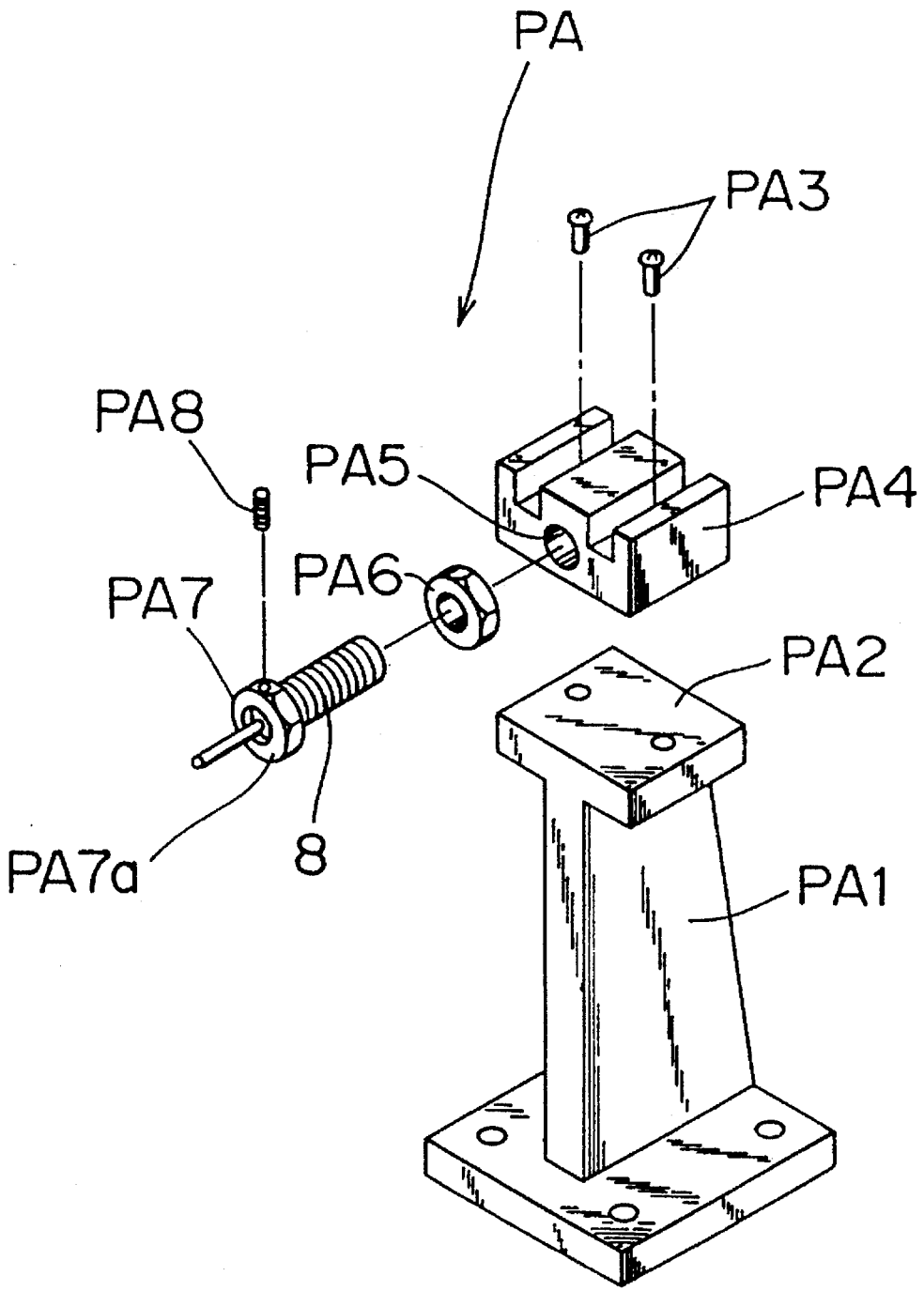
FIG. 4 is an exploded perspective view showing a positioning mechanism.

Referring now to FIG. 1, the positioning mechanisms PA and PB are positioning mechanisms in a case where the front end Wa of the electric wire W is moved to the feeding path R and is stopped. Referring to FIGS. 1 and 4, the positioning mechanism PA comprises i) a base PA1 fixed to the upper surface 1*a* of the machine frame 1, ii) a bracket PA4 having a screw hole PA5 which can be fitted in an outer cylinder 81 of an oil damper 8 by a screw and fixed to an upper surface PA2 of the base PA1 by screws PA3, ii) the oil damper 8 having the outer cylinder 81 screwed into the screw hole PA5, iii) a lock nut PA6 pressed against an end surface of the bracket PA4 in a state where it is fitted in an outer peripheral portion of the outer cylinder 81 of the screwed oil damper 8 for fixing the oil damper 8 to the bracket PA4, iv) a positioning nut PA7 fitted in an end of cylinder of the oil damper 8 by a screw, and v) a hexagon screw PA8 passing through the nut PA7 in the radial direction for fixing the nut PA7 to the oil damper 8.

In the positioning mechanism PA, positioning is obtained by the abutment of an end surface of the swing lever 65*c* and a front end surface PA7*a* of the nut PA7 provided for the oil damper 8.

Furthermore, referring to FIGS. 1 and 5, the positioning mechanism PB comprises i) a bracket PB1 mounted on a front end of the swing lever 66*a* of the back-and-forth moving mechanism 66 by screws PB2 and having an oil damper holding stay PB3 composed of an inclined plate integrally formed on its end surface, ii) an oil damper 8 which can abut against the one positioning surface 65*g* of the projection 65*f* of the circular arm 65*a* in a state where it passes through a screw hole PB4 provided for the oil damper holding stay PB3, iii) a lock nut PB5 for fixing the oil damper 8 to the stay PB3, iv) a positioning nut PB6 which is fitted in the end of cylinder of the oil damper 8 by a screw, and v) a hexagon screw PB8 passing through the nut PB6 in the radial direction for fixing the nut PB6 to the oil damper 8.

In the positioning mechanism PB, positioning is obtained by the abutment of the positioning surface 65*g* of the circular arm 65*a* and a front end surface of the nut PB6 provided for the oil damper 8. In addition, the bracket PB1 is provided with a through hole PB7 for containing a nut 66*g* which is fitted in the screw member 66*b* of the back-and-forth moving mechanism 66 by a screw, and the swing lever 66*a* is provided with a screw hole 66*e* into which the screw member 66*b* is to be screwed.

Figure 3:
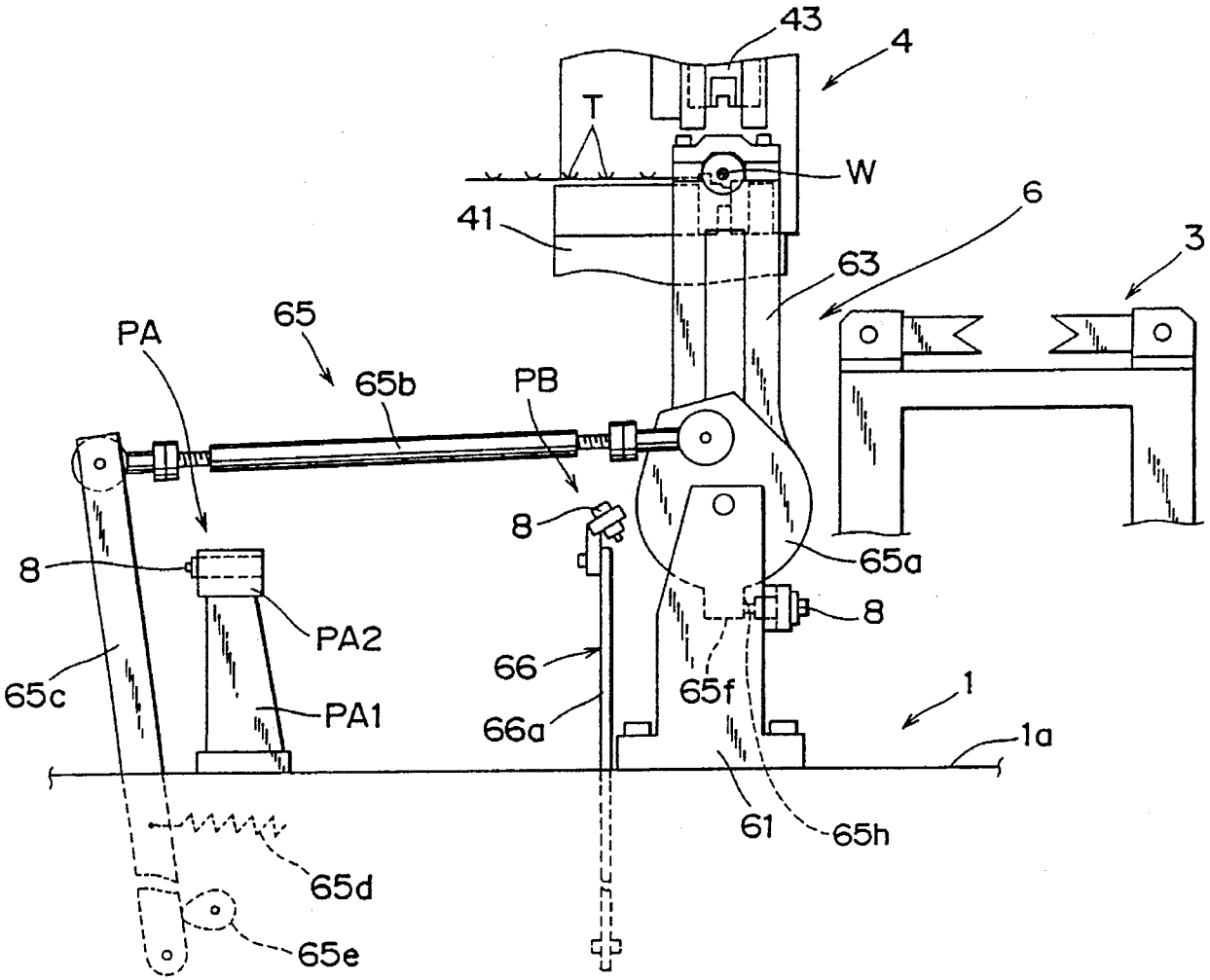
FIG. 3 is a schematic side view showing the continuous terminal crimping machine.
Figure 6:
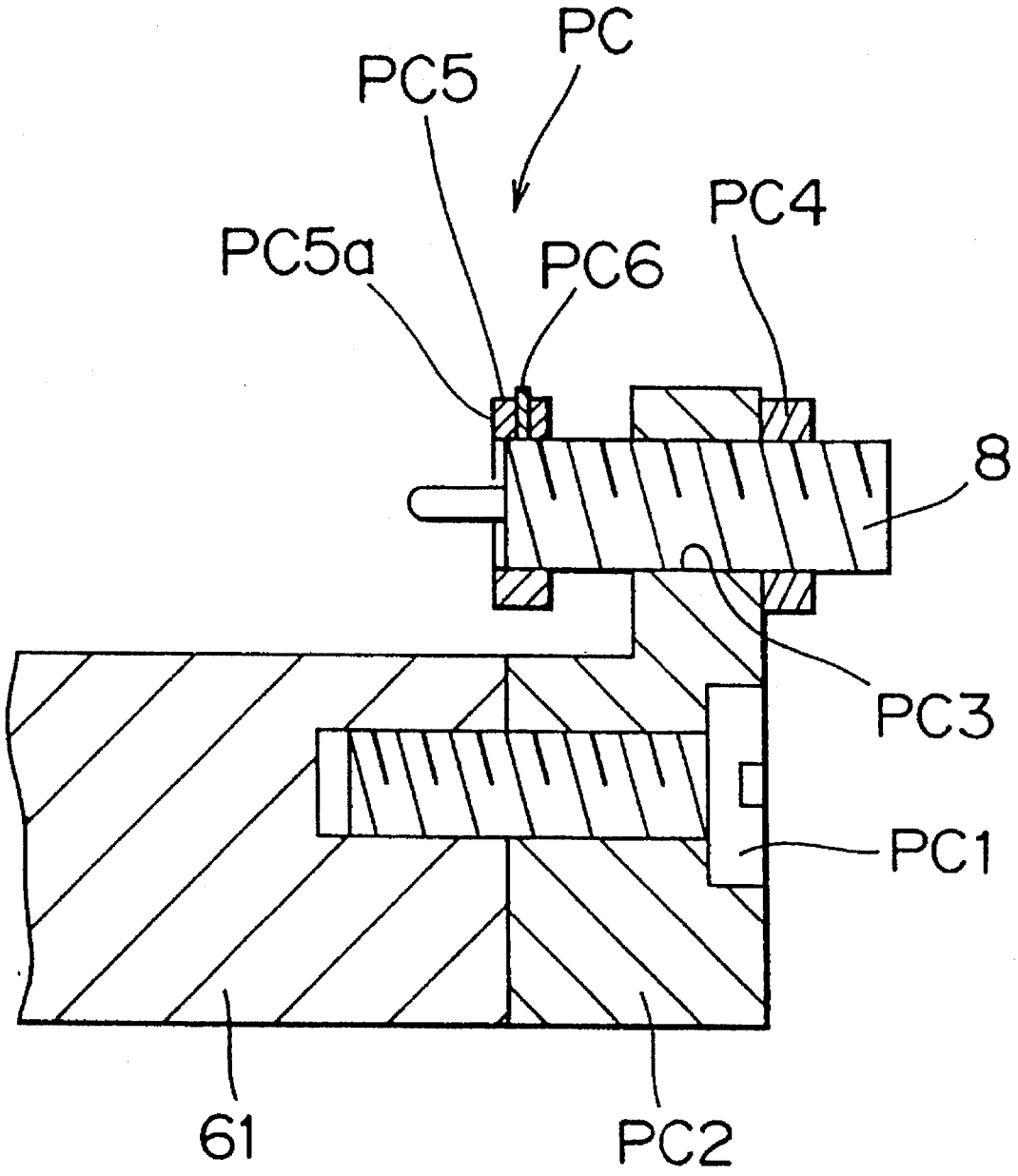
FIG. 6 is a cross sectional view taken along a line VI—VI shown in FIG. 1.

Referring now to FIGS. 3 and 6, the positioning mechanism PC comprises i) a bracket PC2, which is in an L shape in cross section, fixed to a vertical end surface of the pillar body 61 by a screw PC1 and having an oil damper through tapped hole PC3, ii) an oil damper 8 which can abut against the positioning surface 65h of the projection 65*f* of the circular arm 65*a* in a state where it is screwed into the oil damper through tapped hole PC3 of the bracket PC2, iii) a pair of lock nuts PC4 screwed into the oil damper 8 in front of and behind a through portion of the oil damper 8 for fixing the oil damper 8 to the bracket PC2, iv) a positioning nut PC5 which is fitted in an end of cylinder of the oil damper 8 by a screw, and v) a hexagon screw PC6 passing through the nut PC5 in the radial direction for fixing the nut PC5 to the oil damper 8.

In the positioning mechanism PC, positioning is obtained by the abutment of the positioning surface 65*h* of the circular arm 65*a* and a front end surface PC5*a* of the nut PC5 on the side of the oil damper 8.

Figure 7:
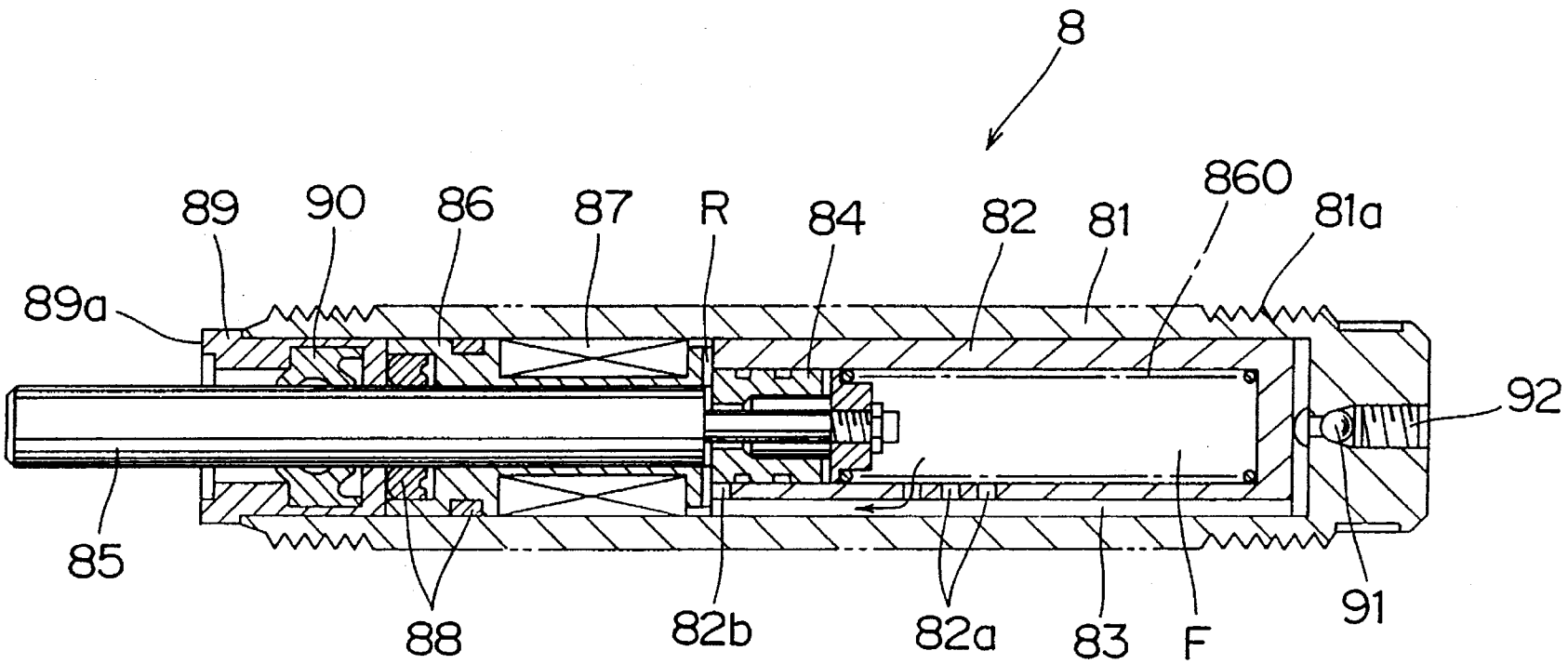
FIG. 7 is a cross sectional view showing an oil damper at the time when it is not operated.
Figure 8:
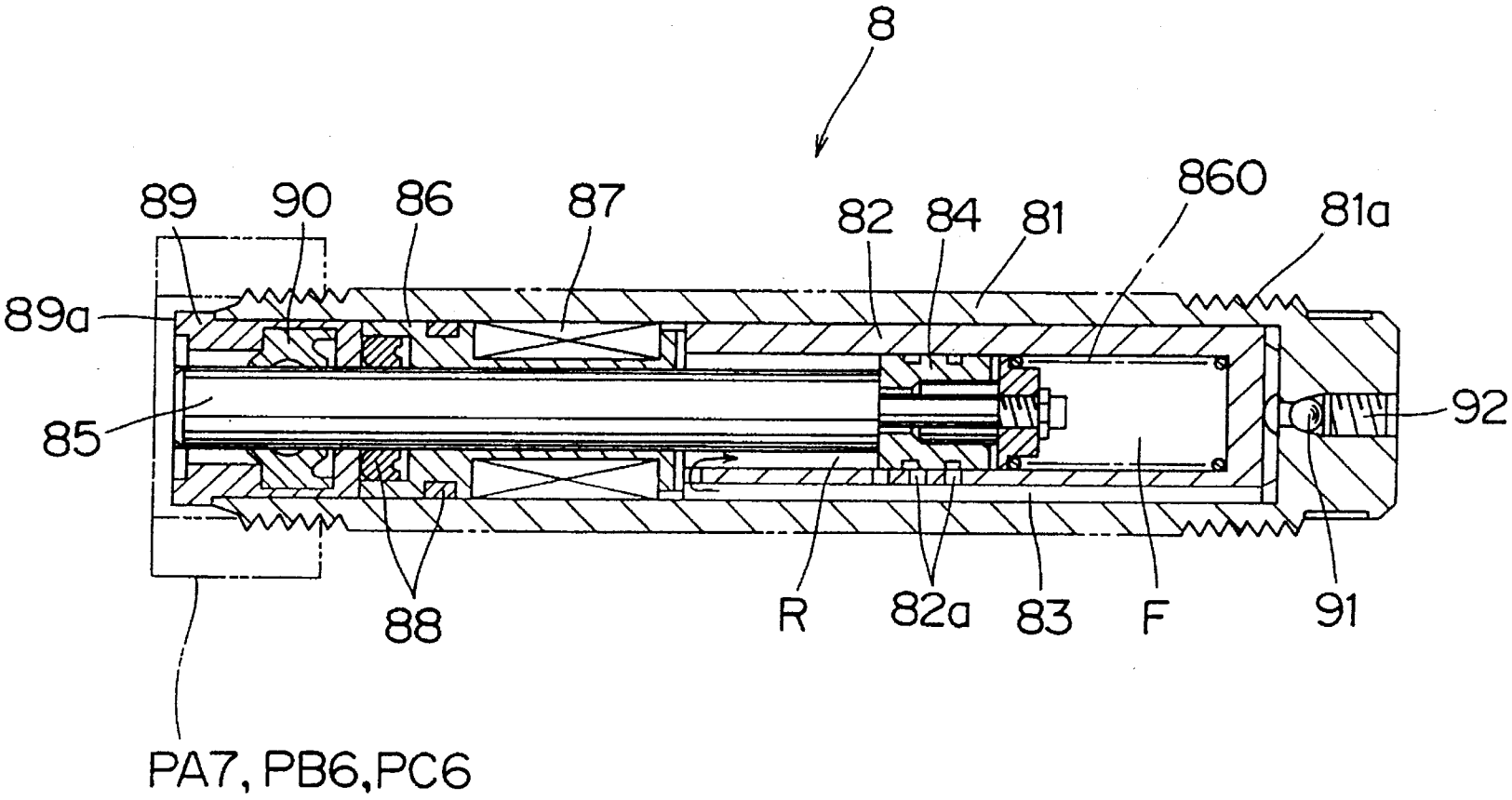
FIG. 8 is a cross sectional view showing the oil damper at the time when it is operated.

Referring now to FIG. 7 showing the state where the oil damper 8 used for each of the positioning mechanisms PA, PB and PC is not operated and FIG. 8 showing the state where the oil damper 8 is operated, the oil damper 8 produces a damping force by viscous resistance of oil leading to an oil chamber R on the rear side in the pressing direction of a piston 84 of an inner cylinder 82 from an oil chamber F on the front side sequentially through communicating holes 82*a*, an oil path 83 and a communicating hole 82*b* in pressing a rod 85 with the piston 84 toward the piston 84, and inertial energy of a rotating member is damped by the damping force.

The oil damper 8 comprises i) an outer cylinder 81 having a screw formed in its outer peripheral portion, ii) the inner cylinder 82 which is fitted in a bottom portion from an axially intermediate portion of the outer cylinder 81 in a state where the oil path 83 axially extending is formed between the inner cylinder 82 and the outer cylinder 81, iii) the piston 84 slidably contained in the inner cylinder 82 for separating the oil chambers F and R on the front and rear sides in the slide direction, iv) the rod 85 axially moved back and forth in a state where the piston 84 is fixed to its front end, v) a compression coil spring 860 for urging the piston 84 in the direction in which the rod 85 extends, vi) a guide rod 86 which is brought into slide contact with an outer peripheral surface of the rod 85 in a state where it is fitted and fixed to an inner peripheral surface of the outer cylinder 81 for guiding the axial movement of the rod 85, vii) an accumulator 87 contained in an annular recess formed on an outer peripheral surface of the guide rod 86 and varying in volume so as to allow the entrance of the rod 85 into the inner cylinder 82, viii) a sealing portion 88 contained in an annular groove formed in the guide rod 86 for sealing a portion between the outer cylinder 81 and the rod 85, ix) a stopper 89 for causing the rod 85 to advance or retreat from a positioning surface 89*a* in a state where it is fitted and fixed to an end of the outer cylinder 81, and x) a scraper 90 held in an annular groove in an inner peripheral portion of the stopper 89. Reference numeral 91 denotes a ball blocking an oil pouring hole at the time of manufacturing the oil damper, and reference numeral 92 denotes a setscrew to which the ball is fixed.

Furthermore, the above described plurality of communicating holes 82*a* arranged in the axial direction which are formed between the inner and outer cylinders 81 and 82 for causing the oil path 83 and the oil chamber F to communicate with each other are formed in a halfway portion in the longitudinal direction on a peripheral side surface of the inner cylinder 82. In addition, the above described communicating hole 82*b* for causing the oil path 83 and the oil chamber R to communicate with each other is formed on the peripheral side surface in an end of the inner cylinder 82.

In this oil damper 8, the rod 85 can be stroked to a state where it is flush with the positioning end surface 89*a* of the stopper 89, as shown in FIG. 8. In each of the positioning mechanisms PA, PB and PC according to the present embodiment, however, the oil damper 8 is so used as not to be stroked until the state shown in FIG. 8 occurs.

Specifically, the positioning mechanisms PA, PB and PC respectively cause nuts PA7, PB6 and PC6 (indicated by a two-dot and dash line in FIG. 8) respectively fitted in an end of the outer cylinder 81 by screws to abut against the end surface of the swing lever 65*c* or the positioning surfaces 65*g* and 65*h* of the circular arm 65*f*, thereby to regulate the position where the rotation of the rotating mechanism 65 is stopped. Consequently, the position where the end of the electric wire W moved is stopped is determined. In addition, the piston 84 sequentially blocks the plurality of communicating holes 82*a* as the rod 85 is moved toward the final stroke position (moved toward a state close to the state shown in FIG. 8), thereby to gradually narrow a flow path. In the final stroke position, there occurs a state where the oil chamber F is substantially sealed. Consequently, the damping force of the oil damper 8 is gradually increased to finally obtain a large damping force.

The piston 84 and the rod 85 which reached the final stroke position are returned to the state where the rod 85 extends as shown in FIG. 7 and are returned toward the oil chamber F from the oil chamber R by the function of the compression coil spring 860.

According to the present embodiment, the oil damper 8 is caused to abut against the swing lever 65*c* and the circular arm 65*a* of the rotating mechanism 65 for moving the end Wa of the electric wire W to the terminal crimping apparatus 4 and the feeding path R to stop the rotation of the rotating mechanism 65 while absorbing a shock by the damping force of the oil damper 8, thereby to make it possible to prevent vibration from being created in the end Wa of the electric wire W at the time of the stop. As a result, it is possible to prevent insufficient crimping of the terminal in the terminal crimping apparatus 4 and insufficient feeding of the electric wire W on the feeding path R which are caused by the vibration. Further, in each portion which receives a shock at the time of the stop, the shock can be released, thereby to make it possible to improve the durability of the portion.

Moreover, the oil damper 8 is included in each of the positioning mechanisms PA to PC, thereby to make it possible to simplify the construction and increase the positioning precision, as compared with a case where they are separately constructed.

In the above described embodiment, one of the positioning mechanisms PA and PB is caused to serve as a positioning mechanism, and the other thereof can contribute to only the absorption of a shock without making metallic contact. In addition, the oil damper 8 and the positioning mechanism can be completely separated. Further, it is preferable in terms of durability that a portion abutting against the front end of the rod 85 of the oil damper 8 (the circular arm 65*a* and the swing lever 65*c*) are subjected to hardening or the like to obtain high hardness.

The present invention is not limited to the above described respective embodiments. For example, the positioning nuts PA7, PB6 and PC6 which are fitted in the oil dampers 8 by screws may be abolished, thereby to make it possible to obtain positioning by the positioning end surface 89*a* of the oil damper 8.

Figure 9:
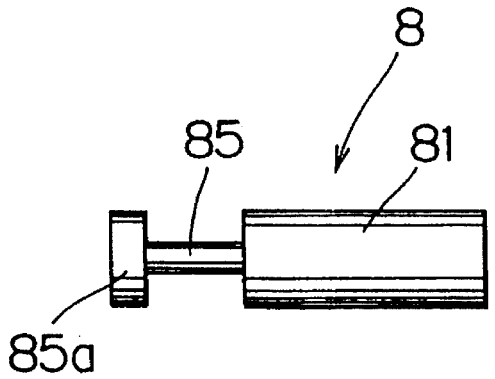
FIG. 9 is a schematic side view showing an oil damper according to another embodiment of the present invention.

Furthermore, as shown in FIG. 9, a bumper portion 85*a* having a larger area than that of an end surface of the rod 85 may be mounted on the front end of the rod 85 of the oil damper 8 to decrease the surface pressure at the time of the abutment, thereby to make it possible to improve the durability of the abutting portion.

Figure 10:
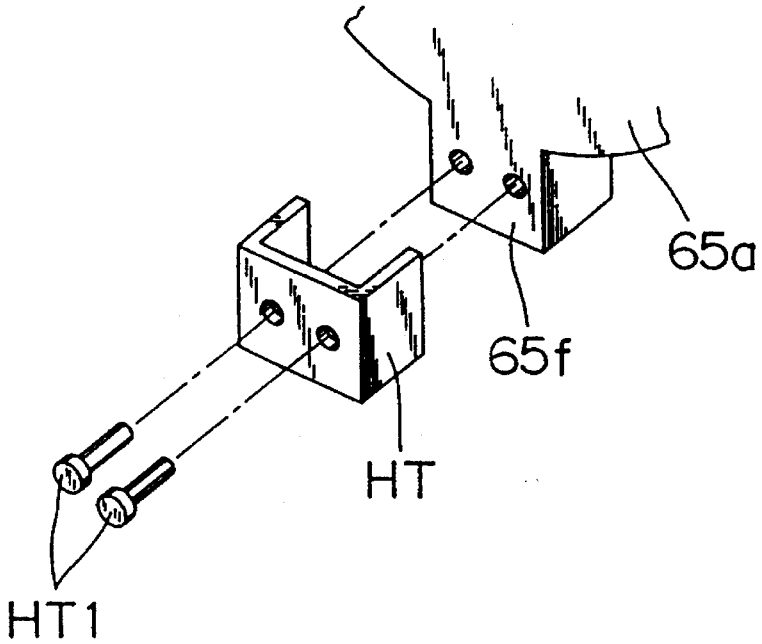
FIG. 10 is a schematic perspective view showing a positioning mechanism according to another embodiment of the present invention.

Furthermore, as shown in FIG. 10, a hard chip HT which is in a channel shape in cross section may be mounted on the projection 65*f* of the circular arm 65*a* by screws HT1 to constitute a positioning surface, in which case it is possible to improve the durability of the abutting portion.

Figure 11A:
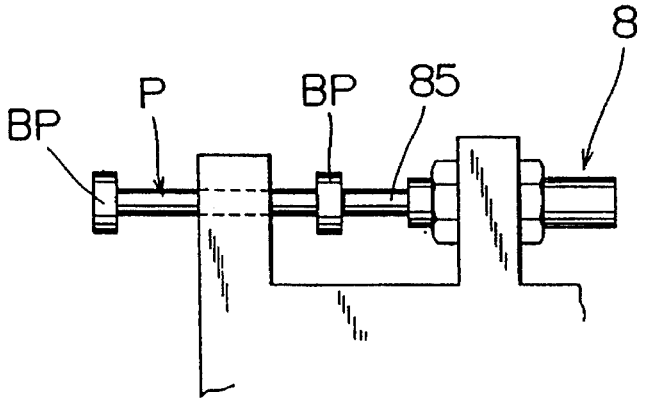
FIG. 11A is a schematic side view showing a positioning mechanism before it determines a position where a rotation of a rotating mechanism is stopped according to still another embodiment of the present invention.
Figure 11B:
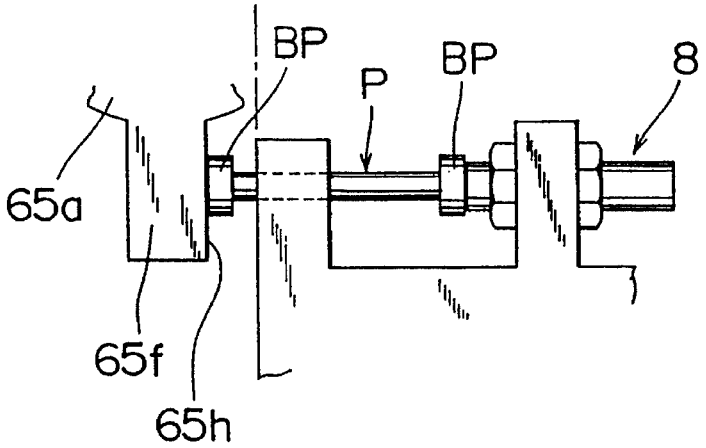
FIG. 11B is a schematic side view showing the positioning mechanism when it determines the position where the rotation of the rotating mechanism is stopped.

Additionally, as shown in FIGS. 11A and 11B [FIG. 11A shows the state where the oil damper 8 is not operated, and FIG. 11B shows the state where the oil damper 8 is operated], a shock may be received through a transmission pin P having bumper portions BP having a larger area than that of the end surface of the rod 85 in both its ends, in which case it is possible to improve the durability of the abutting portion.

Furthermore, a portion against which the oil damper 8 abuts may be the arm 63 or any other members, provided that it displaces as the end Wa of the electric wire W is moved.

Figure 12:
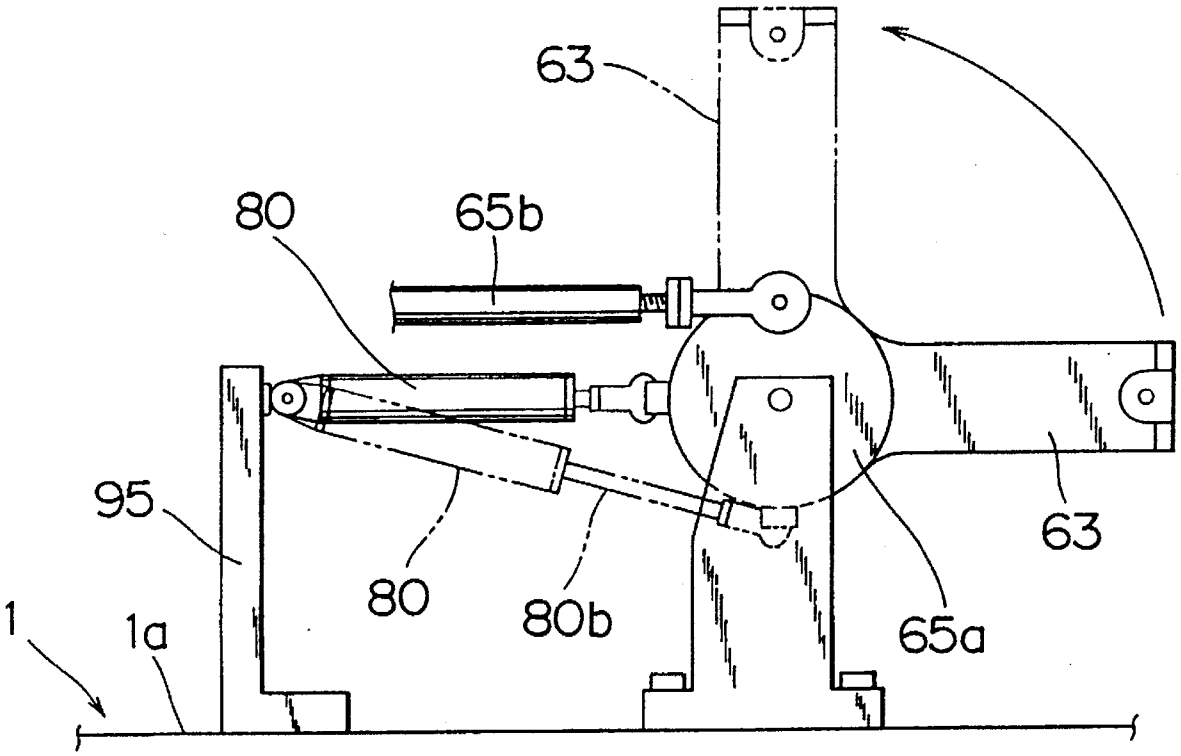
FIG. 12 is a schematic side view showing a state where an oil damper is mounted according to still another embodiment of the present invention.

Furthermore, as shown in FIG. 12, an oil damper 80 serving as a damping force applying portion may be interposed between a pillar body 95 fixed to an upper surface 1*a* of a machine frame 1 and a circular arm 65*a* to exert a damping force immediately before a rod 80*a* of the oil damper 80 reaches the position where it extends to its full length (indicated by a two-dot and dash line in FIG. 12), thereby to make it possible to absorb inertial energy caused by the rotation. In this case, a damping force is produced in both the direction in which the rod 80*a* extends and the direction in which it contracts, thereby to make it possible to further enhance a vibration preventing effect. In addition, the oil damper 80 may also produce a damping force immediately before the rod 80*a* thereof reaches the position where it extends to its full length.

Figure 13:
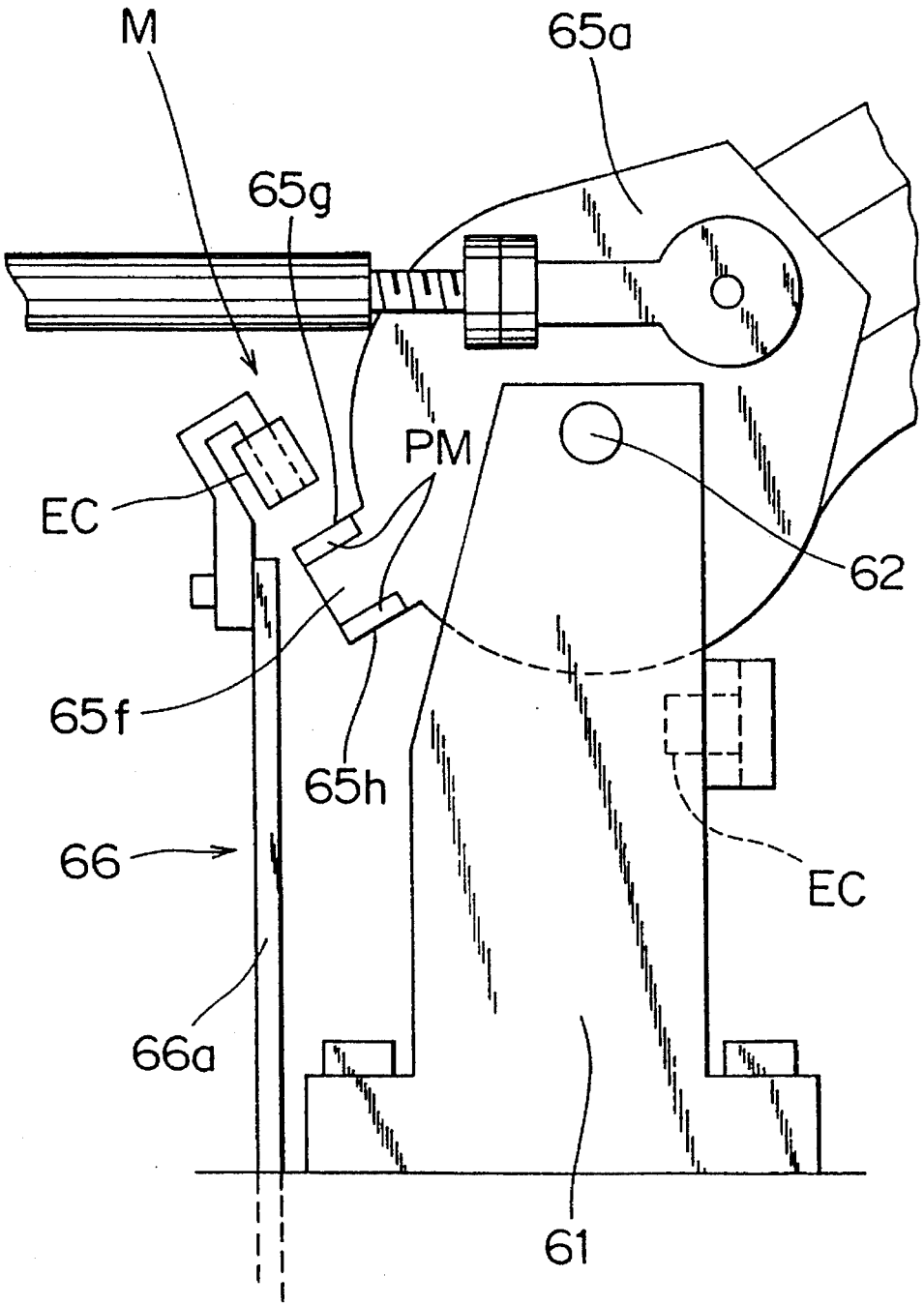
FIG. 13 is a schematic side view showing a damping force applying portion according to still another embodiment of the present invention.

Additionally, a magnetic repulsion mechanism M including an electromagnetic coil EC and a permanent magnet PM may be used to apply a damping force caused by a magnetic repulsion force, as shown in FIG. 13, in place of the oil damper 8 for applying a damping force caused by viscous resistance. In this case, positioning surfaces 65*g* and 65*h* of a circular arm 65*a* are constituted by the permanent magnet PM, and a strong pulse current is applied to the electromagnetic coil EC at a time when the permanent magnet PM is in close proximity thereto.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A continuous terminal crimping machine comprising:

electric wire feeding means for feeding an insulated electric wire along a feeding path;

cutting means for cutting the electric wire fed on said feeding path by said feeding means;

stripping means for stripping an end of the electric wire which has been cut on said feeding path by said cutting means;

a terminal crimping apparatus, disposed beside said feeding path, for crimping a terminal onto the end of the electric wire stripped by said stripping means;

a rotatable arm having a clamping portion for releasably clamping the end of said electric wire stripped by said stripping means, said rotatable arm being rotatable around a predetermined axis parallel to said feeding path between a first position where the end of the electric wire clamped by said clamping portion is placed at a predetermined position on said feeding path, and a second position where the clamped end of the electric wire is placed at a predetermined crimping position, said terminal crimping apparatus crimping the terminal onto the clamped end of the wire at said crimping position;

a rotating mechanism for alternately rotating said rotatable arm to said first position and said second position, said rotating mechanism including a swing lever, linking means for connecting said swing lever to said rotatable arm, urging means for urging said swing lever in a direction, and rotatable eccentric cam means for pushing said swing lever in a direction opposite to said direction of urging by said urging means when said cam means rotates; and shock absorbing means opposed to a predetermined portion of at least one of said rotatable arm and said displaceable member, said shock absorbing means absorbing shock to dampen vibration of the electric wire as said rotatable arm is stopped at said second position.

2. A continuous terminal crimping machine according to claim 1, wherein said shock absorbing means includes a portion abutting against said predetermined portion of said at least one of said rotatable arm and said displaceable member.

3. A continuous terminal crimping machine according to claim 2, wherein said abutting portion of said shock absorbing means includes a positioning surface for regulating the rotation of said rotatable arm at said second position.

4. A continuous terminal crimping machine according to claim 2, wherein said shock absorbing means includes a hydraulic cylinder for producing a damping force to absorb shock by viscous resistance of oil contained in said cylinder.

5. A continuous terminal crimping machine according to claim 4, wherein said hydraulic cylinder includes an oil chamber which is sealable immediately before said rotatable arm is stopped.

6. A continuous terminal crimping machine, comprising:

electric wire feeding means for feeding an insulated electric wire along a feeding path;

cutting means for cutting the electric wire fed on said feeding path by said feeding means;

stripping means for stripping an end of the electric wire which has been cut on said feeding path by said cutting means;

a terminal crimping apparatus, disposed beside said feeding path, for crimping a terminal onto the end of the electric wire stripped by said stripping means;

a rotatable arm having a clamping portion for releasably clamping the end of said electric wire stripped by said stripping means, said rotatable arm being rotatable around a predetermined axis parallel to said feeding path between a first position where the end of the electric wire clamped by said clamping portion is placed at a predetermined position on said feeding path and a second position where the clamped end of the electric wire is placed at a predetermined position in said terminal crimping apparatus;

a rotating mechanism, having a member displaceable as said rotatable arm rotates, for alternately rotating said rotatable arm to said first position and said second position; and shock absorbing means opposed to a predetermined portion of at least one of said rotatable arm and said displaceable member, said shock absorbing means absorbing shock when said rotatable arm is stopped at one of said first and second positions, said shock absorbing means including a pair of magnetic repulsion means respectively provided for a predetermined portion of said at least one of said rotatable arm and said displaceable member, and a member opposed thereto, each repulsion means of said pair thereof repulsing the other.

7. A continuous terminal crimping machine according to claim 6, wherein at least one of said pair of magnetic repulsion means is composed of an electromagnet, said at least one of said pair being excited when the other of said pair of magnetic repulsion means is in close proximity thereto.

8. A continuous terminal crimping machine according to claim 1, further comprising another shock absorbing means, opposed to a predetermined portion of the other of said at least one of said rotatable portion of said rotating arm and said displaceable member, for absorbing shock when said rotatable arm is stopped at said first position.

9. A continuous terminal crimping machine according to claim 8, wherein said another shock absorbing means includes a portion abutting against said predetermined portion to which said another shock absorbing means opposes.

10. A continuous terminal crimping machine according to claim 9, wherein said abutting portion of said another shock absorbing means includes a positioning surface for regulating the rotation of said rotatable arm at said first position.

11. A continuous terminal crimping machine according to claim 9, wherein said another shock absorbing means includes a hydraulic cylinder for producing a damping force to absorb shock by viscous resistance of oil contained in said cylinder.

12. A continuous terminal crimping machine according to claim 11, wherein said hydraulic cylinder includes an oil chamber which is sealable immediately before said rotatable arm is stopped.

* * * * *